US006976473B2

(12) United States Patent
Boos et al.

(10) Patent No.: US 6,976,473 B2
(45) Date of Patent: Dec. 20, 2005

(54) FUEL INJECTION SYSTEM FOR AN INTERNAL COMBUSTION ENGINE

(75) Inventors: Burkhard Boos, Lambsborn (DE); Stefan Kieferle, Stuttgart (DE); Matthias Distel, Ostfildern (DE); Achim Koehler, Ditzingen (DE); Sascha Ambrock, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 218 days.

(21) Appl. No.: 10/420,766

(22) Filed: Apr. 23, 2003

(65) Prior Publication Data

US 2004/0016830 A1 Jan. 29, 2004

(30) Foreign Application Priority Data

Apr. 23, 2002 (DE) ..... 102 18 021

(51) Int. Cl.[7] ..... F02M 33/04
(52) U.S. Cl. ..... 123/446; 123/458
(58) Field of Search ..... 123/446, 447, 123/458, 506

(56) References Cited

U.S. PATENT DOCUMENTS 4,643,155 A * 2/1987 O'Neill ..... 123/506
4,884,545 A * 12/1989 Mathis ..... 123/447
5,762,033 A * 6/1998 Rembold et al. ..... 123/25 C
5,884,606 A * 3/1999 Kellner et al. ..... 123/446
5,927,322 A * 7/1999 Rosenau ..... 137/487.5
5,971,718 A * 10/1999 Krueger et al. ..... 417/286
6,142,747 A * 11/2000 Rosenau et al. ..... 417/251
6,253,734 B1 * 7/2001 Rembold et al. ..... 123/446
2003/0136384 A1 * 7/2003 Linden et al. ..... 123/458

* cited by examiner

*Primary Examiner*—Thomas Moulis
(74) *Attorney, Agent, or Firm*—Ronald E. Greigg

(57) ABSTRACT

The fuel injection system has a high-pressure pump, by which fuel is pumped into a reservoir, with which injectors disposed on cylinders of the engine communicate. A feed pump pumps fuel out of a fuel tank to the high-pressure pump and a fuel metering device triggered by a control unit and disposed between the feed pump and the high-pressure pump controls the fuel quantity delivered to the high-pressure pump. The fuel metering device is formed by a clocking valve, which is opened and closed in pulse-width-modulated fashion by the control unit, and the fuel quantity delivered to the intake side of the high-pressure pump is proportional to the opening duration of the clocking valve.

19 Claims, 2 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Art

One fuel injection system, known from German Patent Disclosure DE 198 53 103, has a high-pressure pump, by which fuel is pumped at high pressure into a reservoir. Injectors disposed on engine cylinders communicate with the reservoir. A feed pump is provided, by which fuel is pumped out of a fuel tank to the intake side of the high-pressure pump. A fuel metering device triggered by an electronic control unit is provided, which is disposed in the communication between the compression side of the feed pump and intake side of the high-pressure pump. The fuel metering device serves to control the fuel quantity pumped into the reservoir by the high-pressure pump, as a function of engine operating parameters. The fuel metering device has a regulating valve, which has a slidelike valve member that is movable by an electromagnet counter to a restoring spring. In cooperation with an outflow opening of the valve housing, the valve member, via its outer jacket and as a function of the stroke, controls a flow cross section in the communication between the feed pump and the high-pressure pump. Throttling of the fuel flow that is flowing to the high-pressure pump is the result. The pressure generated by the feed pump drops in the process, so that the high-pressure pump comes to be filled only partly. The high-pressure pump has poor efficiency as a result. Under certain engine operating conditions, such as in overrunning, the high-pressure pump must not pump any fuel into the reservoir, and this state is known as zero pumping. However, it cannot be assured that the inlet for fuel from the feed pump to the high-pressure pump will be completely closed by the regulating valve, and thus additional provisions are necessary to carry away fuel, pumped by the feed pump and passing through the regulating valve, so that the fuel will not be pumped into the reservoir by the high-pressure pump and so that the zero pumping state will be achieved. These additional provisions in turn worsen the efficiency of the fuel injection system, since some of the fuel pumped by the feed pump flows constantly out in the form of a leakage flow.

OBJECT AND SUMMARY OF THE INVENTION

The fuel injection system of the invention has the advantage over the prior art that because the control valve is embodied as a clocking valve, throttling of the fuel delivered to the intake side of the high-pressure pump does not occur, and thus the filling and the volumetric efficiency of the high-pressure pump are improved. Moreover, the inlet from the feed pump to the intake side of the high-pressure pump can be closed completely in a simple way so that no additional provisions are necessary for assuring the zero pumping of the high-pressure pump; the layout of the fuel injection system is thus simplified and its efficiency is improved.

Other advantageous features and refinements of the fuel injection system of the invention are disclosed. One embodiment assures that excess fuel pumped by the feed pump and not delivered to the intake side of the high-pressure pump can be carried away, while another embodiment assures adequate lubrication of the drive mechanism of the high-pressure pump even when the pump is not pumping any fuel. The invention makes it possible to ventilate the communication between the feed pump and the intake side of the high-pressure pump.

BRIEF DESCRIPTION OF THE DRAWINGS

The invention will be better understood and further objects and advantages thereof will become more apparent from the ensuing detailed description, taken in conjunction with the drawings, in which.

DESCRIPTION OF THE PREFERRED EMBODIMENTS

Figure 1:
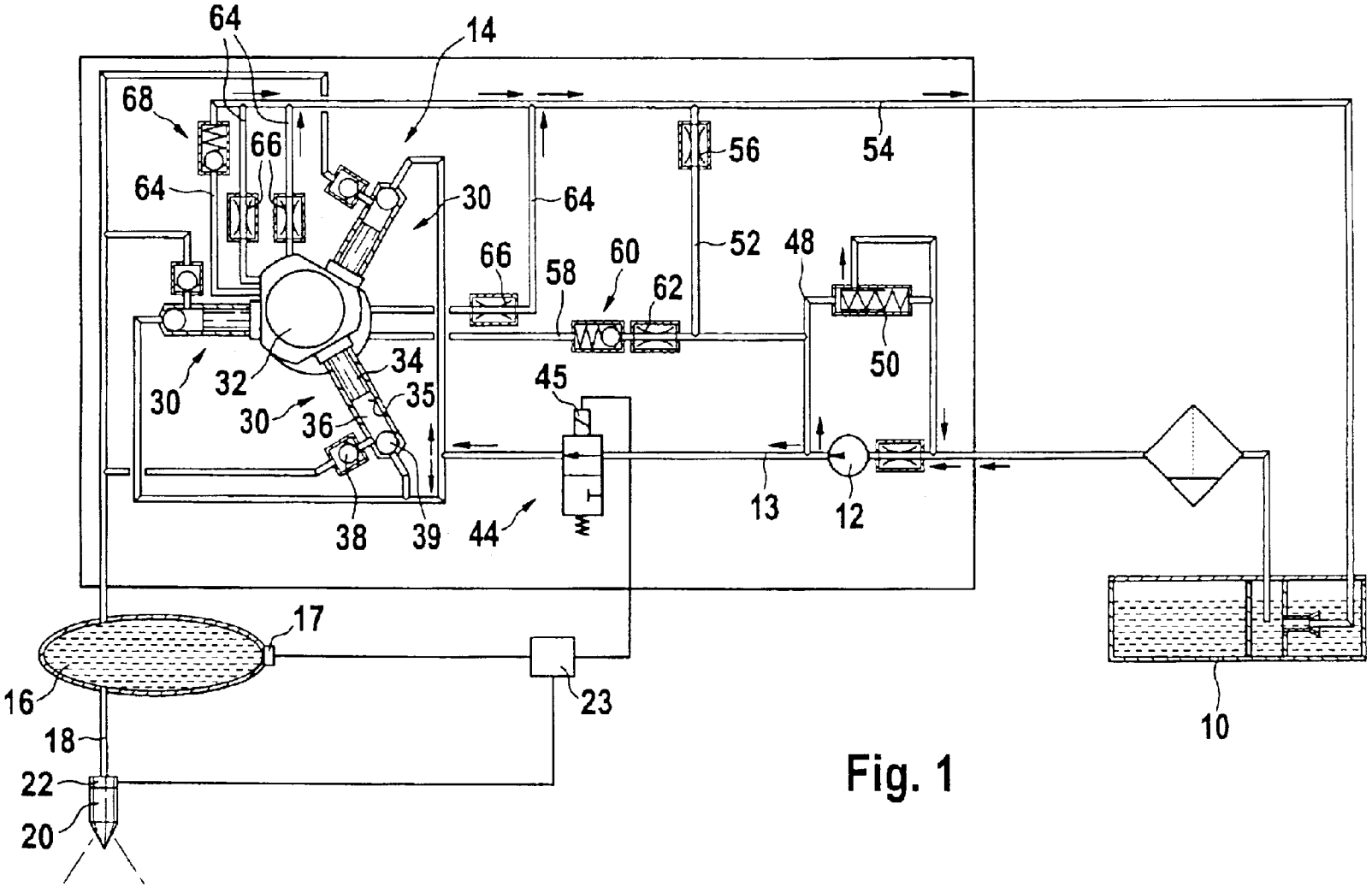
FIG. 1 schematically shows a fuel injection system embodying the invention for use in an internal combustion engine.

In FIG. 1, a fuel injection system for an internal combustion engine, for instance of a motor vehicle, is shown. The engine is preferably a self-igniting engine and has one or more cylinders. The motor vehicle has a fuel tank 10, in which fuel for operating the engine is kept on hand. The fuel injection system has a feed pump 12, by which fuel from the fuel tank 10 is pumped via a communication 13 to the intake side of a high-pressure pump 14. The high-pressure pump 14 pumps fuel into a reservoir 16, which can be embodied in tubular form, for instance, or in some arbitrary other shape. From the reservoir 16, lines 18 lead to injectors 20 disposed on the cylinders of the engine. At each of the injectors 20 there is a respective electrical control valve 22, by which an opening of the injectors is controlled, in order to effect a fuel injection through the respective injector 20 or to prevent a fuel injection. The control valves 22 are triggered by an electronic control unit 23, by which the instant and duration of fuel injection is determined by the injectors 20 as a function of engine operating parameters, such as its rpm, load, temperature, and others.

The high-pressure pump 14 is driven mechanically by the engine and thus in proportion to the engine rpm. The feed pump 12 can likewise be driven mechanically by the engine, and a common drive shaft may be provided for both the high-pressure pump 14 and the feed pump 12. Alternatively, the feed pump 12 can be driven by an electric motor, for instance.

The high-pressure pump 14 can be embodied as a radial piston pump and has a plurality of pump elements 30, for instance three of them at equal angular spacings from one another, which each have one pump piston 34, driven in a reciprocating motion by a common drive mechanism 32, and each pump piston, in a cylinder bore 35, defines a pump work chamber 36. The drive mechanism 32 may for instance have an eccentric shaft and a polygon which is moved by this shaft and on which the pump pistons 34 of the pump elements 30 are braced. In each of the communications of the pump work chambers 36 with the reservoir 16 there is a respective outlet valve 38, in the form of a lubrication communication opening toward the reservoir 16, by which valve the disconnection between the pump work chambers 36 and the reservoir 16 takes place in the intake stroke of the pump pistons 34. In each of the communications of the pump work chambers 36 with the compression side of the feed pump there is a respective inlet valve 39, in the form of a lubrication communication opening toward the pump work chambers 36, by which valve the disconnection between the pump work chambers 36 and the feed pump 12 takes place in the pumping stroke of the pump pistons 34. During a given intake stroke of the pump pistons 34, when the pistons are moving radially inward, the pump work chambers 36 communicate with the outlet of the feed pump 12, with the inlet valves 39 open, and are filled with fuel; the pump work chambers 36 are disconnected from the reservoir 16 by the closed outlet valves 38. During each pumping stroke of the pump pistons 34, when they are moving radially outward, the pump work chambers 36 communicate with the reservoir 16, with the outlet valves 38 open, and are disconnected from the compression side of the feed pump 12 by the closed inlet valves 39.

The fuel injection system furthermore has a fuel metering device 44, which is disposed between the compression side of the feed pump 12 and the intake side of the high-pressure pump 14. The fuel metering device 44 is formed by an electrically actuated clocking valve, which has an actuator, such as an electromagnet or a piezoelectric actuator. The clocking valve can be embodied as a 2/2-way valve. The actuator 45 is triggered by the control unit 23, and the clocking valve 44 can be switched back and forth between an open switching position, in which the communication between the compression side of the feed pump 12 and the intake side of the high-pressure pump 14 is completely opened, and a closed switching position, in which the communication between the compression side of the feed pump 12 and the intake side of the high-pressure pump 14 is interrupted completely. The fuel metering device 44 is triggered in pulse-width-modulated fashion by the control unit 23, in such a way that the opening duration of the clocking valve 44 is long enough that the high-pressure pump 14 is supplied with a defined fuel quantity, which is then in turn pumped at high pressure by the high-pressure pump 14 into the reservoir 16, so as to maintain a predetermined pressure, dependent on engine operating parameters, in the reservoir 16. A pressure sensor 17 disposed in the reservoir 16 is connected to the control unit 23 and transmits signals pertaining to the actual pressure in the reservoir 16 and adjusts the opening duration of the clocking valve 44 in such a way that the flow rate of fuel to the high-pressure pump 14 is adjusted such that the predetermined pressure in the reservoir 16 is attained.

Figure 2:
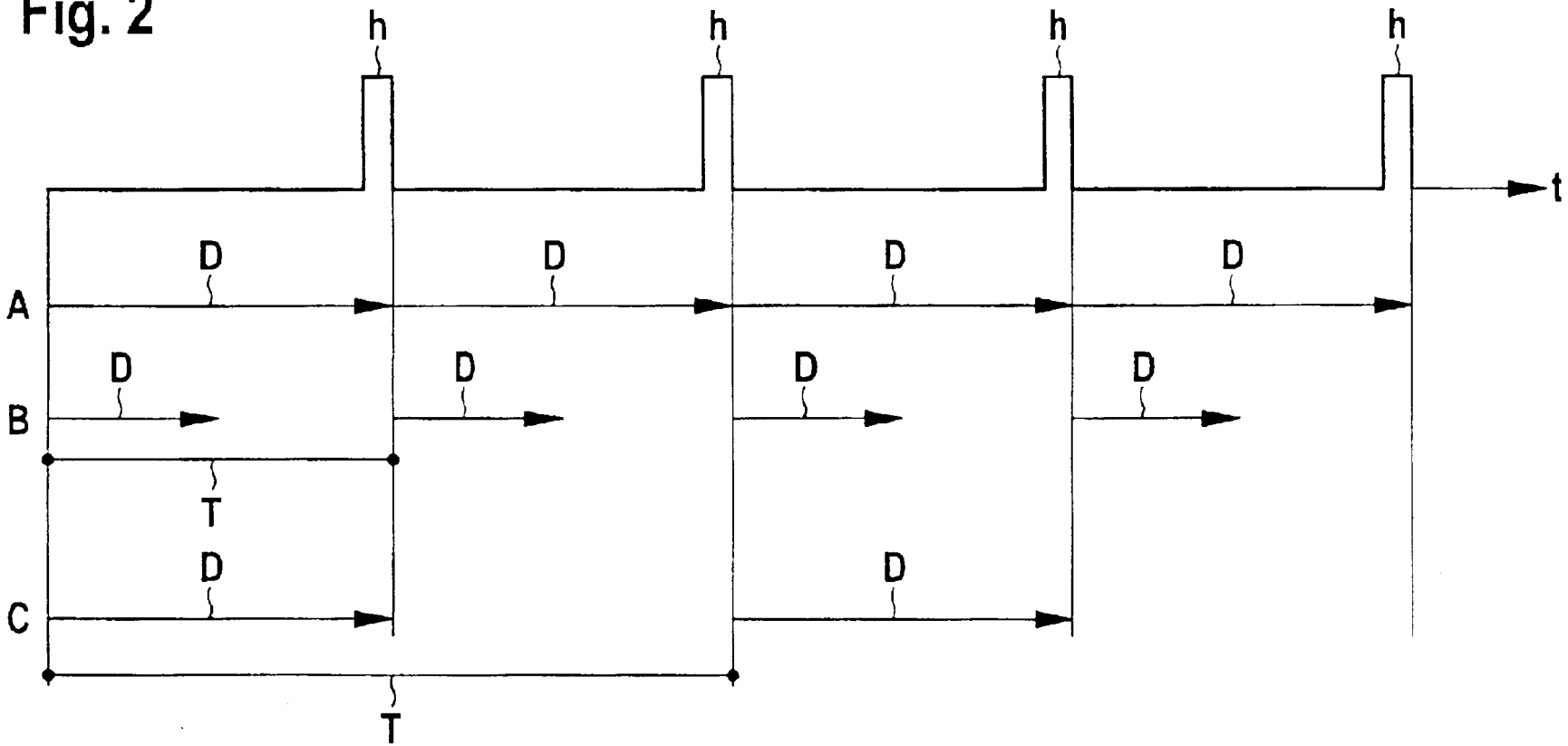
FIG. 2 is a graph showing triggering over time of a clocking valve of the fuel injection system.

The clocking valve 44 is triggered by the control unit 23, preferably synchronously with the intake stroke h of the pump pistons 34 of the pump elements 30, as shown in FIG. 2, in such a way that the opening duration D of the clocking valve 44 during the intake stroke h of the pump piston 34 of a given pump element 30 is so long that the pump piston 34 aspirates a quantity of fuel into the pump work chamber 36 that is then pumped in the ensuing pumping stroke of the pump piston 34 into the reservoir 16, in order to maintain the predetermined pressure in the reservoir 16. The greater the fuel quantity that is to be pumped into the reservoir 16 by the high-pressure pump 14 or its pump elements 30, the longer the opening duration D of the clocking valve 44 will be that is set by the control unit 23. In FIG. 2, the intake stroke h occurring in succession over the time t is shown at the top for the various pump elements 30. At A, the triggering of the clocking valve 44 with an opening duration D for full pumping is shown, at which the clocking valve 44 is open over the entire intake stroke of the pump elements 30. At B, the triggering of the clocking valve 44 is shown with an opening duration D for partial pumping, for instance 50% pumping. The period length of the triggering of the clocking valve 44 is marked T in FIG. 2. Provision may be made so that the clocking valve 44, as shown at B in FIG. 2, at the onset of the intake stroke of a given pump element 30 is initially open and is then closed during the intake stroke once the requisite fuel quantity has been aspirated by the pump element 30. Alternatively, it can be provided that at the onset of the intake stroke of a given pump element 30, the clocking valve 44 is initially closed and is opened during the intake stroke, so that the requisite fuel quantity is aspirated by the pump element 30. The frequency of the pulse width modulation of the clocking valve 44 is adjusted synchronously with the rpm of the high-pressure pump 14.

If at high rpm of the high-pressure pump 14, the requisite opening duration of the clocking valve 44, when control is done separately for each pump element 30, is so short that because of the inertia of the clocking valve 44 this duration can no longer be correctly adjusted, then provision can be made so that, as shown at C in FIG. 2, the clocking valve 44 is opened for only every other pump element 30. Then for one pump element 30 the clocking valve 44 remains completely closed and is opened for a subsequent pump element 30. The period length of the triggering of the clocking valve 44 is again marked T in FIG. 2 at C. The frequency of the pulse width modulation of the clocking valve 44 is adjusted synchronously with a multiple of the rpm of the high-pressure pump 14.

If no fuel can be allowed to be pumped into the reservoir 16 by the high-pressure pump 14, for instance in engine overrunning, the clocking valve 44 is kept closed by the control unit 23, so that no fuel is aspirated by the high-pressure pump 14. Complete tightness of the clocking valve 44 and thus the complete disconnection of the intake side of the high-pressure pump 14 from the compression side of the feed pump 12 by the clocking valve 44 can be attained in a simple way.

It can be provided that the clocking valve 44, in the state in which it is not triggered by the control unit 23, that is, the non energized state, is in its open switching position, and upon triggering by the control unit 23, that is, in the state in which it is acted upon by voltage, it is put in its closed switching position. Alternatively, it can be provided that in the state in which the clocking valve 44 is not triggered by the control unit 23, that is, the non energized state, the clocking valve is in its closed switching position and is put into its open switching position upon triggering by the control unit 23, that is, in the state acted upon by voltage.

The duty cycle for the pulse-width-modulated triggering of the clocking valve 44, that is, the ratio between the triggered duration and the nontriggered duration, and thus the ratio of the opened duration to the closed duration for the intake stroke of the pump elements 30, can be stored in memory in the form of a performance graph in the control unit 23, as a function of the fuel quantity to be pumped into the reservoir 16 by the high-pressure pump 14.

A bypass communication 48 branches off upstream of the clocking valve 44 from the communication 13 between the feed pump 12 and the high-pressure pump 14 and leads to a relief region; the intake side of the feed pump 12 can for instance serve as the relief region. A pressure valve 50 opening toward the relief region is disposed in the bypass communication 48. If full pumping is not to be done by the high-pressure pump 14, and the clocking valve 44 is not constantly open, then the pressure between the feed pump 12 and the clocking valve 44 rises, and if the opening pressure of the pressure valve 50 is exceeded, fuel flows back to the intake side of the feed pump 12.

A further bypass communication 52 branches off upstream of the clocking valve 44 from the communication 13 between the feed pump 12 and the high-pressure pump 14 and leads to a low-pressure region, and a return 54 into the fuel tank 10 can act as this region. A throttle restriction 56 is provided in the further bypass communication 52. By means of the further bypass communication 52, ventilation of the communication 13 between the feed pump 12 and the high-pressure pump 14 is made possible.

A lubrication communication 58 branches off upstream of the clocking valve 44 from the communication 13 between the feed pump 12 and the high-pressure pump 14 to the drive mechanism 32 of the high-pressure pump 14, by which the fuel is delivered to the drive mechanism 32 for lubricating it. A pressure valve 60 is disposed in the lubrication communication 58; it does not open until a predetermined pressure is exceeded and then opens the lubrication communication 58. This assures that particularly upon engine starting, when pressure first has to be built up by the feed pump 12, the fuel pumped by it will be delivered to the high-pressure pump 14, and fuel will not be diverted via the lubrication communication 58. A throttle restriction 62 is also provided in the lubrication communication 58 and limits the fuel quantity delivered to the drive mechanism 32. Relief communications 64 lead away from the drive mechanism 32 of the high-pressure pump 14 to the return 54, and in each of them a respective throttle restriction 66 or a pressure valve 68 that opens toward the return 54 is disposed.

The fuel injection system can also have at least one pressure elevating device disposed between the reservoir 16 and the injectors 20, and by which the pressure of the fuel, delivered to the injectors 20 and attaining injection, is elevated still further compared to the pressure prevailing in the reservoir 16. Each injector 20 can be provided with its own pressure elevating device, which can be integrated with the injector 20.

The foregoing relates to a preferred exemplary embodiment of the invention, it being understood that other variants and embodiments thereof are possible within the spirit and scope of the invention, the latter being defined by the appended claims.

We claim:

1. In a fuel injection system for an internal combustion engine, having a high-pressure pump (14), by which fuel is pumped into a reservoir (16) with which reservoir injectors (20) disposed at cylinders of the engine communicate, having a feed pump (12) by which fuel is pumped from a fuel tank to the intake side of the high-pressure pump (14), and having a fuel metering device (44), which is triggered by a control unit (23) and is disposed between the compression side of the feed pump (12) and the intake side of the high-pressure pump (14) and by which control unit the fuel quantity delivered to the intake side of the high-pressure pump (14) is set, the improvement wherein the fuel metering device comprises a clocking valve (44), which is opened and closed in pulse-width-modulated fashion by the control unit (23), and the fuel quantity delivered to the intake side of the high-pressure pump (14) is proportional to the opening duration of the clocking valve (44); and wherein the frequency of the pulse width modulation of the clocking valve (44) is adjusted preferably synchronously with the rpm or with a multiple of the rpm of the high-pressure pump (14).

2. The fuel injection system according to claim 1, wherein with the clocking valve (44) closed, the intake side of the high-pressure pump (14) is disconnected completely from the compression side of the feed pump (12).

3. The fuel injection system according to claim 1, further comprising a bypass communication (48) upstream of the clocking valve (44) leading away from the communication (13) of the pressure side of the feed pump (12) with the intake side of the high-pressure pump (14) to a relief region, and a pressure valve (50) disposed in the bypass communication (48) that opens toward the relief region.

4. The fuel injection system according to claim 2, further comprising a bypass communication (48) upstream of the clocking valve (44) leading away from the communication (13) of the pressure side of the feed pump (12) with the intake side of the high-pressure pump (14) to a relief region, and a pressure valve (50) disposed in the bypass communication (48) that opens toward the relief region.

5. The fuel injection system according to claim 1, further comprising a lubrication communication (58) upstream of the clocking valve (44) leading away from the communication (13) of the pressure side of the feed pump (12) with the intake side of the high-pressure pump (14), to a drive mechanism (32) of the high-pressure pump (14), and a pressure valve (60) opening toward the drive mechanism (32) and preferably a throttle restriction (62) disposed in the lubrication communication (58).

6. The fuel injection system according to claim 2, further comprising a lubrication communication (58) upstream of the clocking valve (44) leading away from the communication (13) of the pressure side of the feed pump (12) with the intake side of the high-pressure pump (14), to a drive mechanism (32) of the high-pressure pump (14), and a pressure valve (60) opening toward the drive mechanism (32) and preferably a throttle restriction (62) disposed in the lubrication communication (58).

7. The fuel injection system according to claim 3, further comprising a lubrication communication (58) upstream of the clocking valve (44) leading away from the communication (13) of the pressure side of the feed pump (12) with the intake side of the high-pressure pump (14), to a drive mechanism (32) of the high-pressure pump (14), and a pressure valve (60) opening toward the drive mechanism (32) and preferably a throttle restriction (62) disposed in the lubrication communication (58).

8. The fuel injection system according to claim 4, further comprising a lubrication communication (58) upstream of the clocking valve (44) leading away from the communication (13) of the pressure side of the feed pump (12) with the intake side of the high-pressure pump (14), to a drive mechanism (32) of the high-pressure pump (14), and a pressure valve (60) opening toward the drive mechanism (32) and preferably a throttle restriction (62) disposed in the lubrication communication (58).

9. The fuel injection system according to claim 1, further comprising a constantly open communication (52) upstream of the clocking valve (44) leading away from the communication (13) of the pressure side of the feed pump (12) with the intake side of the high-pressure pump (14) to a relief region, and a throttle restriction (56) disposed in the constantly open communication (52).

10. The fuel injection system according to claim 2, further comprising a constantly open communication (52) upstream of the clocking valve (44) leading away from the communication (13) of the pressure side of the feed pump (12) with the intake side of the high-pressure pump (14) to a relief region, and a throttle restriction (56) disposed in the constantly open communication (52).

11. The fuel injection system according to claim 3, further comprising a constantly open communication (52) upstream of the clocking valve (44) leading away from the communication (13) of the pressure side of the feed pump (12) with the intake side of the high-pressure pump (14) to a relief region, and a throttle restriction (56) disposed in the constantly open communication (52).

12. The fuel injection system according to claim 5, further comprising a constantly open communication (52) upstream of the clocking valve (44) leading away from the communication (13) of the pressure side of the feed pump (12) with the intake side of the high-pressure pump (14) to a relief region, and a throttle restriction (56) disposed in the constantly open communication (52).

13. The fuel injection system according to claim 1, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

14. The fuel injection system according to claim 2, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

15. The fuel injection system according to claim 3, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

16. The fuel injection system according to claim 4, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

17. The fuel injection system according to claim 5, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

18. The fuel injection system according to claim 9, wherein the high-pressure pump (14) comprising at least one pump element (30), with a pump piston (34) driven in a reciprocating motion, which piston defines a pump work chamber (36), and the pump piston (34) executes an intake stroke, during which fuel is aspirated into the pump work chamber (36), and a pumping stroke, during which fuel is pumped out of the pump work chamber (36) into the reservoir (16); and wherein the clocking valve (44) is triggered by the control unit (23) during each intake stroke of the pump piston (34).

19. The fuel injection system according to claim 13, characterized in that the high-pressure pump (14) comprises a plurality of pump elements (30), whose pump pistons (34) execute their respective intake stroke and pumping stroke chronologically offset from one another; and wherein the clocking valve (44) is triggered by the control unit (23) during each intake stroke of the pump piston (34) of a pump element (30).

* * * * *